US005667061A

United States Patent [19]

Lee

[11] Patent Number: 5,667,061

[45] Date of Patent: Sep. 16, 1997

[54] LINEAR CAM-ASSISTED PLUNGER SWITCH

[75] Inventor: James Sungioun Lee, Niles, Ohio

[73] Assignee: Packard Hughes Interconnect Company, Irvine, Calif.

[21] Appl. No.: 673,586

[22] Filed: Jul. 1, 1996

[51] Int. Cl.[6] ..... H01H 13/14

[52] U.S. Cl. ..... 200/533; 200/534

[58] Field of Search ..... 200/533, 517, 200/534, 536

[56] References Cited

U.S. PATENT DOCUMENTS

| | | | |
|---|---|---|---|
| 3,857,007 | 12/1974 | Leuenberger | 200/533 X |
| 3,912,894 | 10/1975 | Mullen et al. | 200/533 |
| 4,160,885 | 7/1979 | Ellicott et al. | 200/535 X |
| 4,427,856 | 1/1984 | Atsumi et al. | 200/442 |
| 5,412,164 | 5/1995 | Conway et al. | 200/517 X |
| 5,426,275 | 6/1995 | Maeda et al. | 200/553 |

*Primary Examiner*—Renee S. Luebke
*Attorney, Agent, or Firm*—Cary W. Brooks

[57] ABSTRACT

A linear cam-assisted plunger switch including a cam member having a body portion and at least three outwardly extending wedge-shaped arms. The wedge-shaped arms having a flat surface and a sloped surface formed at an angle with respect to the flat surface and converging in a direction of the flat surface. A housing base is constructed and arranged to slidably receive the cam member. A support member is connected to the base and has spaced apart electrical contacts and an electrical circuit associated therewith. A non-metallic, flexible dome is carried by said support member, and an electrically conductive element is positioned on the underside of the dome for engagement with the spaced apart contacts and closing said circuit when said dome is collapsed.

4 Claims, 2 Drawing Sheets

LINEAR CAM-ASSISTED PLUNGER SWITCH

FIELD OF THE INVENTION

This invention relates to electrical switches.

BACKGROUND OF THE INVENTION

Electrical switches having plunger buttons or large buttons are often unstable and wobble upon activation. This wobbling presents a poor quality of feel. In some automobile applications, large buttons are called for. Previously, rib and guide systems were used to minimize the wobble on large automotive buttons. These rib and guide systems require a length that is a function of the size of the button. Large buttons require long rib and guides, which thus require a longer depth associated with the switch box. Sometimes depth length is constrained in automobile or other applications and therefore rib and guide systems cannot be used.

The present invention provides alternatives and advantages over the prior art.

SUMMARY OF THE INVENTION

A linear cam-assisted plunger switch including a cam member having a body portion and at least three outwardly extending wedge-shaped arms. The wedge-shaped arms having a flat surface and a sloped surface formed at an angle with respect to the flat surface and converging in a direction of the flat surface. A housing base is constructed and arranged to slidably receive the cam member. A support member is connected to the base and has spaced apart electrical contacts and an electrical circuit associated therewith. A non-metallic, flexible dome is carried by said support member, and an electrically conductive element is positioned on the underside of the dome for engagement with the spaced apart contacts and closing said circuit when said dome is collapsed. A keycap is provided having at least one downwardly extending wedge-shaped leg for each of the wedge-shaped arms on said cam member. The wedge-shaped leg has a flat surface and a sloped surface formed at an angle to said flat surface and converging thereon. The wedge-shaped legs are constructed and arranged for slidable movement of said sloped surface of the leg over the sloped surface of the arm.

These and other objects, features and advantages of the present invention will become apparent from the following brief description of the drawings, detailed description and appended claims and drawings.

DETAILED DESCRIPTION

Figure 1:
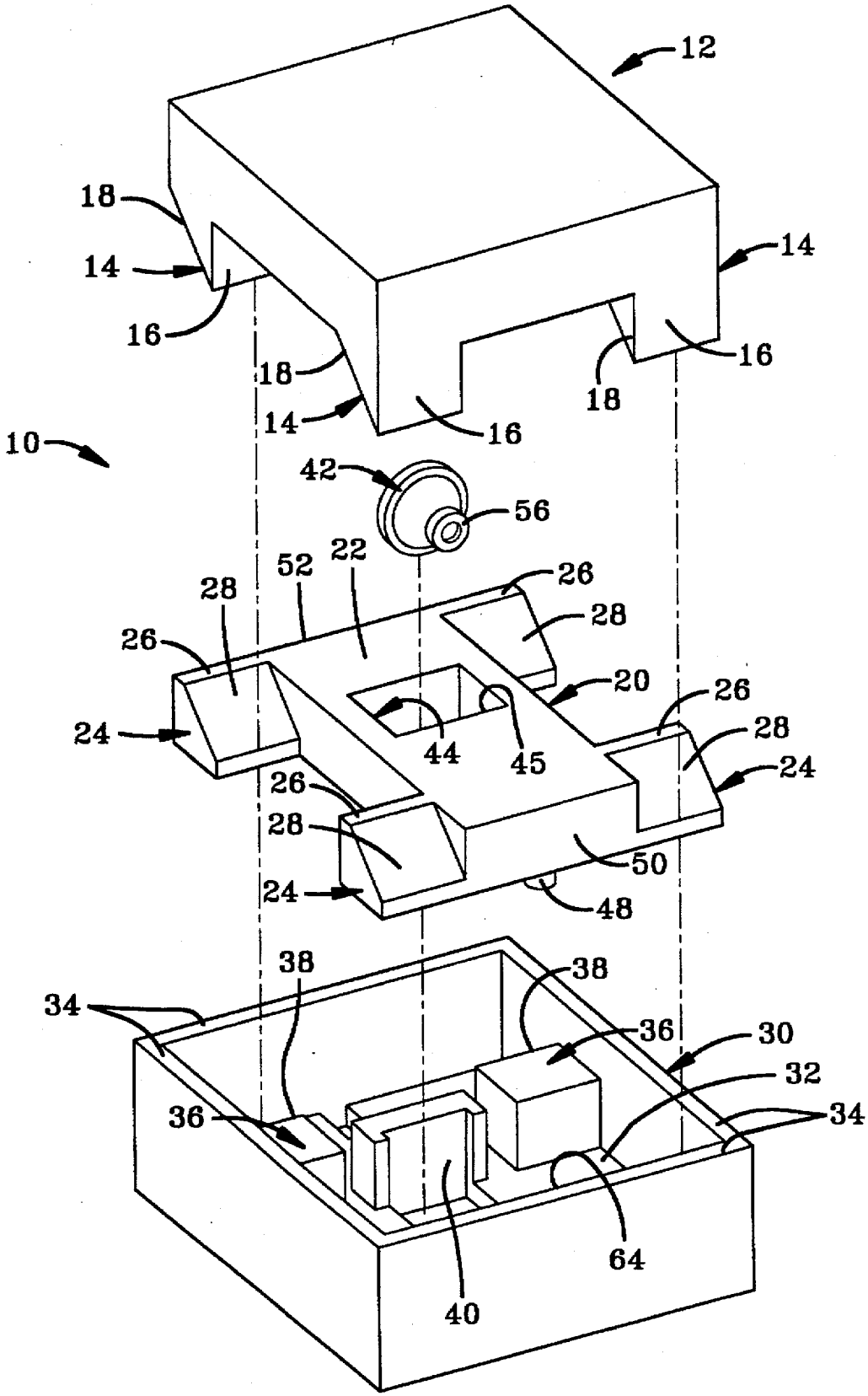
FIG. 1 is an exploded view of a linear cam-assisted plunger switch according to the present invention.
Figure 2:
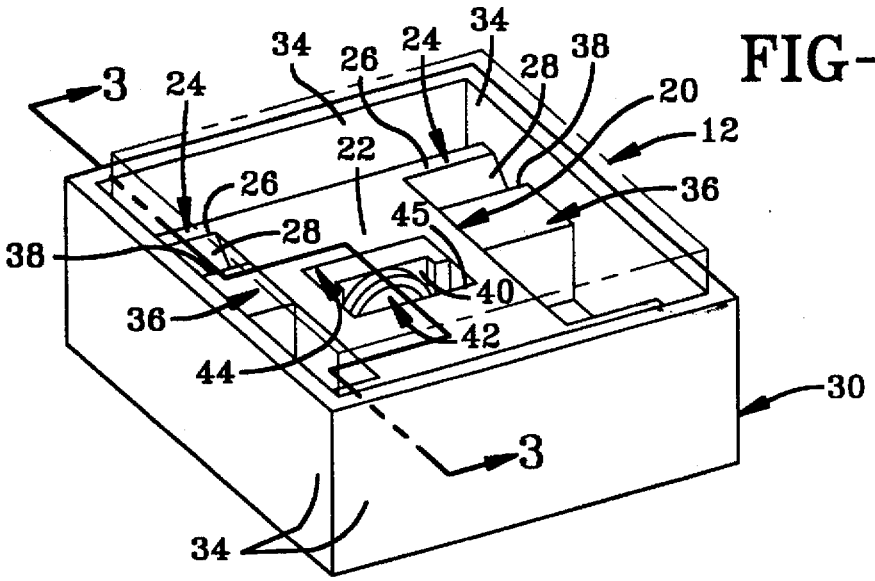
FIG. 2 is a perspective view of a switch according to the present invention.
Figure 3:
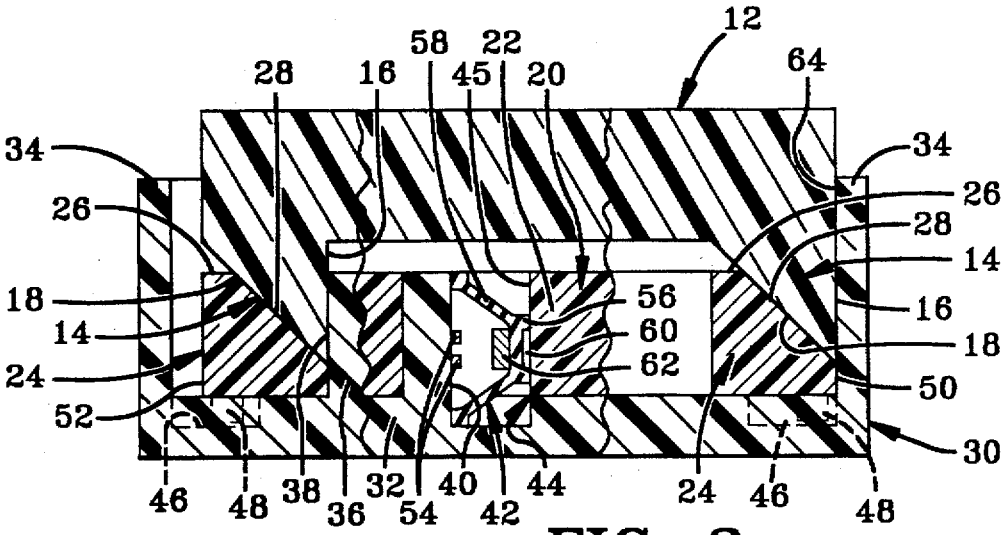
FIG. 3 is a sectional view taken along line 3—3 of FIG. 2.

The present invention includes a linear cam-assisted plunger switch 10. A keycap or button 12 is provided with three or more cam contact legs 14 extending downward from a top surface of a keycap. Each contact leg is wedge-shaped having a flat outer surface 16 and a sloped surface 18 formed at an angle to the outer surface 16. A linear cam 20 is provided having a body portion 22 and separate outwardly extending arm 24 for engagement with a respective leg of the keycap. The outwardly extending arms 24 are also wedge-shaped. The arm 24 includes a flat top surface 26 and a second sloped surface 28 formed at an angle to the flat top surface 26 and converging thereon. A housing 30 is provided having a base 32 and four upwardly extending walls 34. Attached to the base 32 are at least two spaced apart blocks 36 having a flat surface 38 extending upwardly and perpendicular to the base and constructed and arranged for slidable engagement with the flat surface 16 of a wedge-shaped keycap leg 14. A support surface 40 extends upwardly from the base 32 and a collapsible dome 42 is carried thereon. The body portion of the linear cam 20 has a hole 44 formed therethrough and constructed and arranged so that the support surface 40 and the collapsible dome 42 can be received within the hole 44. An inner surface 45 of the body portion 22 which defines the hole 44 constantly engages the collapsible dome 42. The base 32 portion of the housing has guide grooves 46 formed therein for receiving two guide pegs 48 wherein one of the pegs extends downwardly from the body portion 22 near respective front 50 and rear ends 52 of the linear cam.

Figure 4:
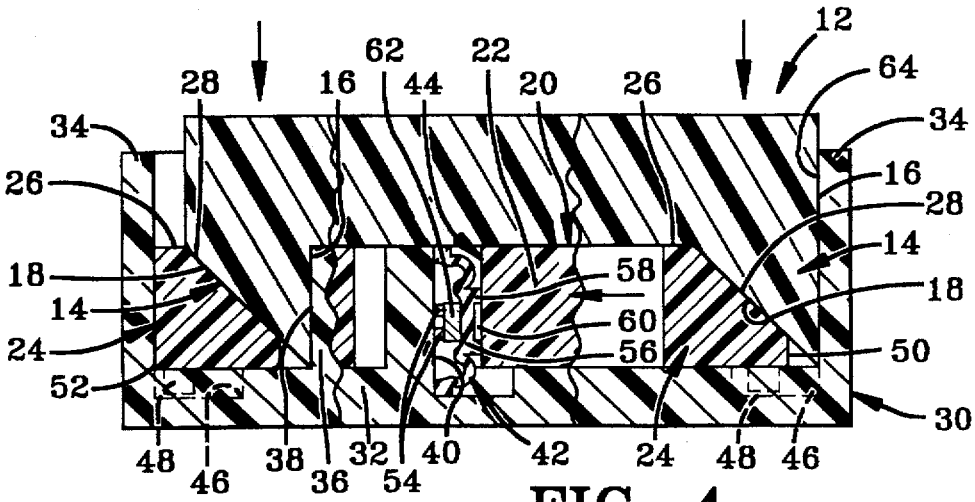
FIG. 4 is a view similar to FIG. 3 with the keycap in a depressed position.

In one embodiment of the invention the switch includes a stationary support surface 40 carrying a plurality of closely spaced contacts or ends of traces 54 of a printed circuit, a non-metallic, flexible, preferably elastic dome 42 which is mounted on the stationary support surface 40 or printed circuit which overlies the contacts or ends of the traces. The elastomeric dome 42 has a resilient, annular outer ring 56 of a given thickness, and downwardly extending flexible side walls 58. A thinner membrane 60 underlines the annular ring and an electrically conductive pellet 62 is carried on the underside thereof. As the keycap 12 is depressed by the operator, the downwardly extending wedge-shaped legs 14 engage the sloped surfaces 28 of the linear cam arms 24 causing the cam as shown in FIG. 4 to move in a linear direction against the force of the dome. The keycap 12 is further guided by the flat surface 16 of the wedge-shaped legs 14 of the keycap which slide along the flat surface 38 of the guide blocks or a flat surface 64 of the housing wall 34. Each wedge-shaped leg 14 of the keycap 12 is identically constructed, and each wedge-shaped arm 24 of the cam 20 is identically constructed. Consequently, the displacement of the keycap legs 14 are identical as the keycap is depressed, thus eliminating any wobble of the keycap. As shown in the preferred embodiment of FIG. 1, the keycap 12 has four spaced apart identical downwardly extending wedge-shaped legs 14. Likewise, the linear cam 20 has four corresponding identical outwardly extending wedge-shaped arms 24. When the dome 42 is depressed by the linear cam 20, the side walls 58 deflect outwardly to move the conductive element 62 on the thinner membrane 60 into engagement with the associated contacts or ends of the circuit traces 54 on the printed circuit thus closing the switch. The housing wall 34 and the support surface 40 act as stops for the cam.

When the operator removes his/her finger from the keycap 12 and the associated downward pressure on the keycap is removed the elastomeric dome 14 acts as a spring moving the linear cam 20 back to its original position and forcing the keycap to move upwardly to its original position and so that the switch is opened.

The dome 42 may be made from a silicone or other suitable resilient or elastomeric material. As will be appreciated, the dome may be supported by any structure including the housing in a position for biasing the linear cam to a first position when no downward pressure is placed on the keycap.

What is claimed is:

1. A linear cam-assisted plunger switch comprising:

a cam member having a body portion and at least three outwardly extending wedge-shaped arms, said wedge-shaped arms having a flat surface and a sloped surface formed at an angle with respect to the flat surface and converging in a direction of the flat surface;

a base constructed and arranged for slidably receiving said cam member, a support member connected to the base, said support member having spaced apart electrical contacts and an electrical circuit associated therewith, a non-metallic, flexible dome carried by said support member, said flexible dome having an electrically conductive element on an underside of the dome positioned for engagement with said spaced apart contacts and closing said circuit when said dome is collapsed;

a keycap having at least one downwardly extending wedge-shaped leg for each of the wedge-shaped arms on said cam member, said wedge-shaped leg having a flat surface and a sloped surface formed at an angle to said flat surface and converging thereon, said wedge-shaped leg being constructed and arranged for slidable movement of the sloped surface of the leg over the sloped surface of the arm of the cam;

said dome being positioned, when fully extended, to bias said cam in a first direction wherein said keycap is in an upward-most position, and wherein said keycap is depressible to a second position wherein said cam is linearly displaced along said base to a second position causing said dome to be collapsed and said conductive element engaging said spaced apart electrical contacts to close said electrical circuit.

2. A linear cam-assisted plunger switch as set forth in claim 1 further comprising at least two spaced apart guide blocks mounted on said base, each of said blocks having a flat face extending in a perpendicular direction from said base and positioned for engaging the flat surface of the said wedge-shaped legs of the keycap and guiding the keycap when it is depressed.

3. A linear cam-assisted plunger switch as set forth in claim 1 further comprising a guide groove formed in said base and wherein said cam member further includes a downwardly extending guide pin for slidable movement in said guide groove of said base.

4. A linear cam-assisted plunger switch as set forth in claim 1 wherein said cam member has a hole formed in said body portion and is constructed and arranged for receiving said support member and said dome member therein so that the dome member is in engagement with a wall defining said hole in said body portion.

* * * * *

UNITED STATES PATENT AND TRADEMARK OFFICE

CERTIFICATE OF CORRECTION

PATENT NO. : 5,667,061

DATED : September 16, 1997

INVENTOR(S) : James Sungioun Lee

It is certified that error appears in the above-identified patent and that said Letters Patent is hereby corrected as shown below:

Item [75],

Title page: The inventor's name should be -- JAMES SUNGJOON LEE --.

Signed and Sealed this

Ninth Day of June, 1998

*Attest:*

*Attesting Officer*

BRUCE LEHMAN

*Commissioner of Patents and Trademarks*